United States Patent [19]

Link et al.

[11] 4,114,324

[45] Sep. 19, 1978

[54] SILO FOR BULK MATERIALS WITH FLUIDIZING MEANS

[75] Inventors: Otmar Link, Büchen-Gotzingen; Gerhard Nied, Rosenberg, both of Fed. Rep. of Germany

[73] Assignee: AZO-Maschinenfabrik Adolf Zimmermann, Fed. Rep. of Germany

[21] Appl. No.: 775,527

[22] Filed: Mar. 8, 1977

[30] Foreign Application Priority Data

Mar. 23, 1976 [DE] Fed. Rep. of Germany ..... 2612258

[51] Int. Cl.[2] ..... E04B 1/345; E04H 7/22

[52] U.S. Cl. ..... 52/2; 52/63; 52/192; 52/303; 98/55

[58] Field of Search ..... 98/55, 52, 54; 52/192, 52/303, 197, 302, 194, 195, 221, 196, 676, 2, 63, 246

[56] References Cited

U.S. PATENT DOCUMENTS

| | | | |
|---|---|---|---|
| 2,281,269 | 4/1942 | Costello | 98/54 |
| 2,524,331 | 10/1950 | Rysdon | 98/55 |
| 2,818,009 | 12/1957 | Steffen | 52/302 X |
| 2,867,112 | 1/1959 | Krone | 52/676 |
| 2,901,960 | 9/1959 | Barre et al. | 98/55 |
| 3,426,445 | 2/1969 | Steffen | 52/192 X |
| 3,538,957 | 11/1970 | Rheaume | 52/2 |
| 3,591,994 | 7/1971 | Steffen | 52/303 X |
| 4,009,520 | 3/1977 | Sukup | 98/55 X |

FOREIGN PATENT DOCUMENTS

| | | | |
|---|---|---|---|
| 787,657 | 9/1935 | France | 52/303 |

*Primary Examiner*—Leslie Braun
*Attorney, Agent, or Firm*—Craig & Antonelli

[57] ABSTRACT

A silo for bulk materials has a rigid base and a fluidizing means which comprises an air-pervious mesh floor arranged above the rigid base, a support surface means holding the said floor in spaced relation relatively to the rigid base and at least one compressed air supply duct opening into the intermediate space between the rigid base and the mesh floor, the support surface means being formed by a wire gauze placed on the rigid base. The wire mesh may be annular and may be in sector-shape portions with a radially extending packing or seal arranged between each of the separate sectors and a compressed air supply duct associated with each sector. A helical wire mesh is particularly described and illustrated, with tube sections arranged as seals on the terminal wire helices.

8 Claims, 3 Drawing Figures

SILO FOR BULK MATERIALS WITH FLUIDIZING MEANS

The invention relates to a silo for bulk materials, having a rigid base and a fluidizing means or device which comprises an air-pervious mesh floor arranged above the rigid base, a support surface means holding the said floor spaced from the rigid base and at least one compressed air supply duct opening into the intermediate space between the rigid base and the mesh floor.

Many constructional forms of silos having a fluidizing device are known. Fluidizing devices are more especially employed when the silo contains bulk materials having difficult flow properties, for the purpose of loosening and keeping them fluid, for example, so that they can be removed by gravity or through a suction nozzle. The known fluidizing devices comprise either rigid, air-pervious flow plates, for example, in the form of perforated plates, porous ceramic plates or the like. The first-mentioned constructional forms have the disadvantage that the air is not evenly distributed or, if this is to be achieved by a suitably small spacing of the apertures, the perforated plate has to be separately supported on the rigid base of the silo. Porous ceramic plates, on the other hand, are very expensive and fragile, for which reason they have not proved to be viable in practice.

By contrast, flow plates consisting of a resilient fabric or mesh of natural or artificial fibres are particularly advantageous. Owing to the fine-mesh arrangement of the apertures, the fluidizing air is distributed very evenly over the whole cross-section of the silo. At the same time, the advantage is obtained that when compressed air is admitted to the mesh floor, the latter swells elastically and thus also imparts a machanical and loosening movement to the bulk material. However, these mesh floors also require a separate support structure, for maintaining the necessary spacing relatively to the rigid base. This support structure generally consists of a perforated plate, which itself also has to be supported. This involves not only a suitable material, but a not inconsiderable amount of expense for assembly.

The invention has for its object to provide an inexpensive support surface means which requires practically no expense for manufacture and assembly and in addition does not offer any substantial resistance to the distribution of the compressed air.

This object is achieved in a surprisingly simple manner, according to the invention, by the support surface means being constituted by a wire mesh laid on the rigid base.

In the first place, such a wire mesh is very cheap to produce. It can easily be cut to the required size in a few stages and then only has to be laid on the rigid base. The mesh floor is laid directly on the wire gauze, so that it is even possibly bulged as far as the rigid base under load, while the intermediate space beneath the mesh floor is traversed by evenly spaced ducts for the distribution of the compressed air. As soon as the compressed air is supplied, the mesh floor is raised, also alongside the ducts provided, and the air thus passes in practice underneath the entire floor. However, even when the mesh floor is not raised, only a few points of contact exist between the wire mesh and the mesh floor which do not contribute to the distribution of the compressed air.

It is sufficient if the wire mesh is made annular, since it is of main importance that the fluidizing air is distributed in the outer region of the silo.

According to one preferred embodiment of the invention, the support surface means is composed of wire mesh which is made sector-shaped. In this way, a minimum of cutting is involved, more especially with round silos. With rectangular silos, it is even possible in this way to avoid any cutting, by the different mesh sectors being placed one against the other.

In connection with silos having a fluidizing device, it is known to admit compressed air to the air-pervious floor, sector by sector. This results in what may be termed all-round aeration, with the advantage of a smaller air requirement and a relative movement of the columns of material over each sector. For such a case it is now proposed, according to a feature of the invention, that a radially extending packing or seal is arranged between each of the individual wire mesh sectors, it being possible for compressed air to be separately admitted to each sector. In this way, the individual sectors are easily sealed off from one another, so that an aeration is actually always only carried out sector by sector.

In a preferred embodiment of the invention, the wire mesh is a helical wire mesh, which thus consists of individual wire helices hooked into one another. Such a wire mesh has several advantages. On the one hand, practically annular channels are formed inside each helix, while on the other hand an appreciable spacing between the mesh floor and the rigid base is assured by the said helices. Another important advantage consists in that simple rectangular cut-out pieces are possible, since the wire mesh can be compressed as desired in its plane, the individual wire helices being pushed one within the other in an approximately radial direction. For stabilizing the wire mesh in the required shape, it is sufficient if a bracing wire or the like is provided on the side edges extending transversely of the wire helices.

With an aeration in sectors, such a helical wire mesh also provides the possibility of tube sections being arranged on the terminal helices of the wire mesh as packings or seals for the separate sectors. These tube sections can for example be slit longitudinally and applied from the side on to the terminal helices. A particularly simple and inexpensive sealing of the separate sectors is achieved in this way.

The invention is hereinafter described, by way of example, with reference to a preferred constructional form illustrated in the accompanying drawing, wherein.

Figure 1:
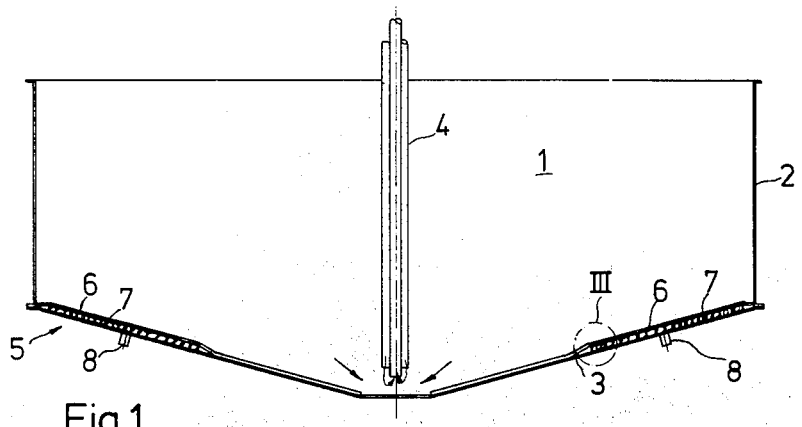
FIG. 1 is a diagrammatic longitudinal section through a silo having a fluidizing device or means.

Illustrated in FIG. 1 is what may be termed a flat-bottomed silo 1, but the invention is not restricted to such flat-bottomed silos. The silo consists of a cylindrical wall 2, which is possibly composed of several sections and, in the embodiment as illustrated, of a slightly conical base 3. In the example as illustrated, a suction nozzle or pipe 4 serves for removing the material stored in the silo 1. It is also possible instead to provide for removal by gravity. So as also to be able to extract materials which only flow with difficulty, a fluidizing device or means 5 is provided in the region of the base 3 of the silo 1, said device consisting of a mesh floor 6, which, as previously noted, is conventionally formed in fluidizing devices of a resilient fabric or mesh, a support device or means 7 holding the said floor spaced from the rigid base 3 and one or more compressed air supply ducts 8.

Figure 2:
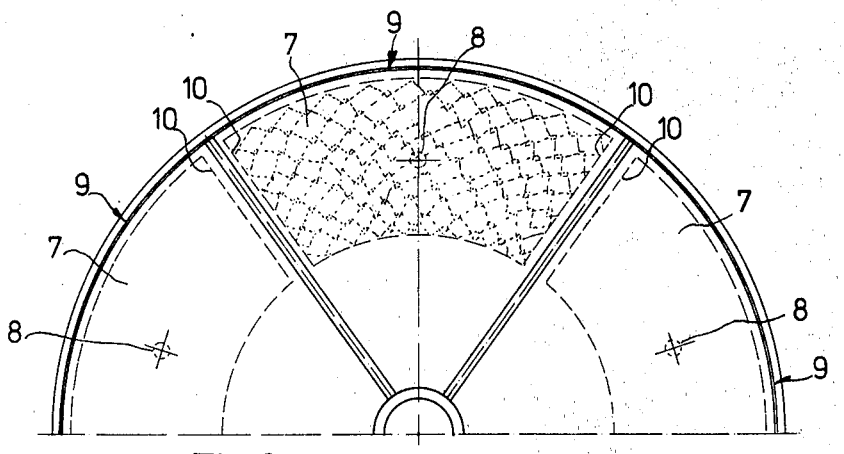
FIG. 2 is a plan view of the base of the silo.

It can be seen from FIG. 2 that the support surface 7, in the constructional form as described, is subdivided into several sectors 9, each of which has a compressed air duct 8 associated with it. Arranged between the separate sectors 9 are packings or seals 10, which bear on one side against the rigid base 3 and on the other side against the mesh floor 6. By alternate admission of air through the compressed air pipes 8, only one sector 9 at a time is aerated.

Figure 3:
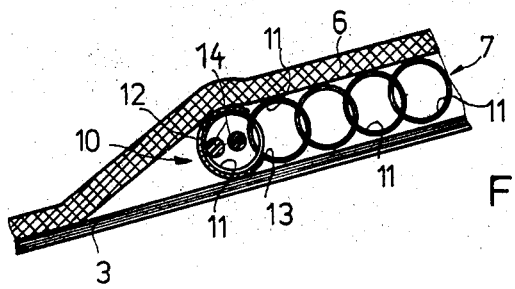
FIG. 3 shows the detail III in FIG. 1 to a larger scale.

Serving as support surface means 7, in accordance with the invention, is a wire mesh which, as will be seen in FIG. 3, is advantageously formed as a helical wire mesh. Such a helical wire mesh consists of a plurality of wire helices 11 which extend in parallel relation and are hooked into one another. This helical wire mesh can be easily brought to any desired shape, for example, into the form of the sectors 7, by the individual wire helices 11 being compressed transversely of and in the direction of their length. Serving as a seal 10, which is effective between the separate sectors 9, a tube 12 of an elastic material is used with such a helical wire mesh, said tube having a longitudinal slit 13 and being pushed from the side on to the terminal wire helices 11 of each sector 9. A support wire 14 can be threaded transversely of the length of the wire helices and in the direction thereof, so as to keep the wire mesh dimensionally stable.

In the constructional example as shown in the drawing, the sectors 9 are made part-annular. They extend from the outer periphery of the rigid base 3 as far as an arc, which makes up approximately one third of the total diameter. It is of course also possible instead for the support surface to extend over the entire rigid base or even to be made in the form of a plurality of concentric rings. The wire mesh can be made of a metal wire, but also of a synthetic plastics wire. Instead of the helical wire mesh, it is also possible to employ a plain wire mesh or netting, but the wire mesh should in any case possess a certain extension transversely of its plane, so as to provide a sufficient spacing for the mesh floor 6.

What is claimed is:

1. Silos for bulk materials, comprising a rigid base and a fluidizing means which comprises an air-pervious floor of a resilient fabric or mesh of natural or artificial fibres arranged above the rigid base, a support surface means holding the said floor in spaced relation relatively to the rigid base and at least one compressed air supply duct opening into the intermediate space between the rigid base and the mesh floor, the support surface means being constituted by a helical wire laid on the rigid base.

2. Silo according to claim 1, wherein tube sections are arranged as seals on the terminal wire helices of the wire mesh.

3. Silo according to claim 1, wherein the tube sections are slit longitudinally and are applied from the side on to the terminal wire helices.

4. A silo according to claim 1, wherein said mesh support means supports said mesh floor in a manner enabling the floor to swell elastically when compressed air is admitted to said intermediate space.

5. A silo for bulk materials, comprising a rigid base, fluidizing means for placing stored materials in a suspended state, said fluidizing means including an air-pervious mesh floor of a resilient fabric or mesh of natural or artificial fibres arranged above the rigid base, wire mesh support means in supportive contact with said mesh floor for holding said mesh floor in spaced relation with respect to said rigid base, and at least one compressed air supply duct opening into an intermediate space between the rigid base and the mesh floor, said support means supporting said mesh floor in a manner enabling the floor to swell elastically when compressed air is supplied to said intermediate space.

6. Silo according to claim 5, wherein the wire mesh support means is annular.

7. Silo according to claim 5, wherein the support means is composed of sector-shaped portions of wire mesh.

8. Silo according to claim 7, wherein a radially extending packing or seal is arranged between each of the separate sectors and a compressed air supply duct is associated with each sector.

* * * * *